US011164502B2

(12) United States Patent
Zhu et al.

(10) Patent No.: US 11,164,502 B2
(45) Date of Patent: Nov. 2, 2021

(54) DISPLAY PANEL AND DRIVING METHOD THEREOF AND DISPLAY DEVICE

(71) Applicant: BOE Technology Group Co., Ltd., Beijing (CN)

(72) Inventors: Jianchao Zhu, Beijing (CN); Yu Feng, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/967,186

(22) PCT Filed: Dec. 17, 2019

(86) PCT No.: PCT/CN2019/126088
§ 371 (c)(1),
(2) Date: Aug. 4, 2020

(87) PCT Pub. No.: WO2020/151414
PCT Pub. Date: Jul. 30, 2020

(65) Prior Publication Data

US 2021/0082333 A1 Mar. 18, 2021

(30) Foreign Application Priority Data

Jan. 24, 2019 (CN) ..... 201910069202.4

(51) Int. Cl.
*G09G 3/20* (2006.01)
*G09G 3/3233* (2016.01)

(52) U.S. Cl.
CPC ..... *G09G 3/2003* (2013.01); *G09G 3/3233* (2013.01); *G09G 2300/0452* (2013.01);
(Continued)

(58) Field of Classification Search
CPC ..... G09G 3/2003; G09G 3/3233; G09G 2300/0452; G09G 2320/0276;
(Continued)

(56) References Cited

U.S. PATENT DOCUMENTS 9,190,457 B2 * 11/2015 Im ..... H01L 27/3246
10,043,442 B2 * 8/2018 Hsu ..... G09G 3/3208
(Continued)

FOREIGN PATENT DOCUMENTS

CN 102411914 A 4/2012
CN 103345887 A 10/2013
(Continued)

OTHER PUBLICATIONS

International search report of PCT application No. PCT/CN2019/126088 dated Mar. 6, 2020.
(Continued)

*Primary Examiner* — Grant Sitta
(74) *Attorney, Agent, or Firm* — Fay Sharpe LLP

(57) ABSTRACT

The present application discloses a display panel (1) and a driving method thereof, and a display device. The display panel (1) includes: a plurality of first pixel units (11) and at least one second pixel unit (12), wherein each of the first pixel units (11) and the second pixel unit (12) includes a plurality of sub-pixels; each of the sub-pixels in the first pixel unit (11) is in one sub-pixel region, and there are two of the sub-pixels in the first pixel unit (11) whose emission colors are a first color; and the plurality of sub-pixels in the second pixel unit (12) is in a plurality of sub-pixel regions arranged in an array, there are two adjacent sub-pixels in the second pixel unit (12) whose emission colors are the first color, and the two adjacent sub-pixels are in the same sub-pixel region.

18 Claims, 3 Drawing Sheets

(52) U.S. Cl.
CPC ..... *G09G 2320/0276* (2013.01); *G09G 2320/0673* (2013.01); *G09G 2340/0457* (2013.01)

(58) Field of Classification Search
CPC ... G09G 2320/0673; G09G 2340/0457; G09G 3/3225
See application file for complete search history.

(56) References Cited

U.S. PATENT DOCUMENTS

| | | | | |
|---|---|---|---|---|
| 10,210,826 | B2 * | 2/2019 | Chuang | G09G 3/3607 |
| 10,672,319 | B2 * | 6/2020 | Kimura | G09G 3/2003 |
| 10,714,001 | B2 * | 7/2020 | Cok | H01L 27/3276 |
| 10,923,077 | B2 * | 2/2021 | Matsueda | G09G 3/2003 |
| 2008/0049048 | A1 | 2/2008 | Credelle et al. | |
| 2009/0174730 | A1 | 7/2009 | Huang et al. | |
| 2009/0309813 | A1 | 12/2009 | Fujita | |
| 2010/0013848 | A1 * | 1/2010 | Hekstra | G09G 3/20 345/589 |
| 2011/0272675 | A1 * | 11/2011 | Chung | H01L 27/3246 257/40 |
| 2011/0292087 | A1 * | 12/2011 | Lim | G09G 3/3225 345/690 |
| 2014/0111115 | A1 * | 4/2014 | Bai | H01L 27/3218 315/312 |
| 2014/0232735 | A1 * | 8/2014 | Jeong | G09G 5/04 345/589 |
| 2016/0055820 | A1 * | 2/2016 | Chu Ke | G09G 3/2003 345/690 |
| 2016/0104413 | A1 * | 4/2016 | Matsueda | H01L 27/3218 345/694 |
| 2016/0163770 | A1 * | 6/2016 | Kim | H01L 27/3218 257/40 |
| 2018/0182827 | A1 * | 6/2018 | Kim | H01L 27/3258 |
| 2018/0190729 | A1 * | 7/2018 | Chu-Ke | G09G 3/3607 |
| 2019/0319079 | A1 * | 10/2019 | Xing | H01L 27/3213 |
| 2020/0258443 | A1 * | 8/2020 | Xu | G09G 3/3607 |
| 2021/0065625 | A1 * | 3/2021 | Wang | G09G 3/3266 |
| 2021/0074776 | A1 * | 3/2021 | Huangfu | G09G 3/30 |
| 2021/0082322 | A1 * | 3/2021 | Chen | G02F 1/133514 |
| 2021/0183965 | A1 * | 6/2021 | Wang | H01L 27/3216 |

FOREIGN PATENT DOCUMENTS

| | | | |
|---|---|---|---|
| CN | 103366680 | A | 10/2013 |
| CN | 204904727 | U | 12/2015 |
| CN | 201710005236.8 | * | 5/2017 |
| CN | 107633802 | A | 1/2018 |
| CN | 108596147 | A | 9/2018 |
| CN | 108922900 | A | 11/2018 |
| CN | 109036245 | A | 12/2018 |
| CN | 109036257 | A | 12/2018 |
| CN | 109147644 | A | 1/2019 |
| CN | 109192076 | A | 1/2019 |
| CN | 109637452 | A | 4/2019 |
| TW | 201503346 | A | 1/2015 |

OTHER PUBLICATIONS

First office action of Chinese application No. 201910069202.4 dated Feb. 6, 2020.
Pengfei Li,et al; Concept and Technology of Under Screen Fingerprint Identification; Dec. 31, 2018.
Siwei Li, et al; Full screen mobile phone technology and trend analysis; Dec. 15, 2017.

* cited by examiner

DISPLAY PANEL AND DRIVING METHOD THEREOF AND DISPLAY DEVICE

This application is a 371 of PCT Application No. PCT/CN2019/126088, filed on Dec. 17, 2019, which claims priority to Chinese Patent Application No. 201910069202.4, filed on Jan. 24, 2019 and entitled "DISPLAY PANEL AND DRIVING METHOD THEREOF AND DISPLAY DEVICE", the entire contents of which are incorporated herein by reference.

TECHNICAL FIELD

The present application relates to a display panel and a driving method thereof, and a display device.

BACKGROUND

As the display technology develops, an organic light-emitting diode (OLED) display panel can achieve local transparent display. For example, the OLED display panel includes a transparent region and a non-transparent region. A PPI (pixels per inch, also called a pixel density) of the transparent region is less than a PPI of the non-transparent region, so that local transparent display can be achieved.

SUMMARY

The present application provides a display panel and a driving method thereof, and a display device. The technical solutions are as follows.

In a first aspect, a display panel is provided. The display panel includes: a plurality of first pixel units and at least one second pixel unit, wherein each of the first pixel units and the second pixel unit includes a plurality of sub-pixels;

each of the sub-pixels in the first pixel unit is located in one sub-pixel region, and there are two of the sub-pixels in the first pixel unit, whose emission colors are a first color;

the plurality of sub-pixels in the second pixel unit is located in a plurality of sub-pixel regions arranged in an array, there are two adjacent sub-pixels in the second pixel unit, whose emission colors are the first color, and the two adjacent sub-pixels are located in the same sub-pixel region; and when the first pixel units and the second pixel unit are in a white balance state, a light-emitting current of the sub-pixel whose emission color is a second color is equal to that of the sub-pixel whose emission color is a third color, and is two times a light-emitting current of the sub-pixel whose emission color is the first color, light-emitting currents of the sub-pixels whose emission colors are the same are equal, and the first color, the second color and the third color are different from one another.

Optionally, light-emitting surfaces of the plurality of sub-pixels in the first pixel unit are equal in area, and light-emitting surfaces of the plurality of sub-pixels in the second pixel unit are equal in area.

Optionally, the display panel has a transparent region in which the second pixel unit is located; and a non-transparent region in which the first pixel unit is located.

Optionally, the first pixel unit includes the plurality of sub-pixels arranged in a sub-pixel rendering (SPR) mode.

Optionally, the first pixel unit includes a first sub-pixel, a second sub-pixel, a third sub-pixel, and a fourth sub-pixel which are sequentially arranged along a data line scanning direction, wherein emission colors of both the second sub-pixel and the fourth sub-pixel are the first color, an emission color of the first sub-pixel is the second color, and an emission color of the third sub-pixel is the third color.

Optionally, the second pixel unit includes a first sub-pixel, a second sub-pixel, a third sub-pixel, and a fourth sub-pixel which are sequentially arranged along the data line scanning direction, wherein an emission color of the first sub-pixel is the second color, emission colors of both the second sub-pixel and the third sub-pixel are the first color, and an emission color of the fourth sub-pixel is the third color.

Optionally, the first color is green, the second color is red, and the third color is blue.

Optionally, the display panel is an electroluminescent display panel.

In a second aspect, a display panel driving method is provided. The display panel driving method is applied to the display panel according to the first aspect or any optional mode of the first aspect, wherein the display panel includes a plurality of first pixel units and at least one second pixel unit, wherein each of the first pixel unit and the second pixel unit includes a plurality of sub-pixels; and the method includes:

determining a group of gamma curves corresponding to the first pixel unit, wherein the group of gamma curves includes gamma curves corresponding to the sub-pixels having different colors in the first pixel unit, and the gamma curve indicates an association relationship between a gamma voltage and a light-emitting current of the corresponding sub-pixel;

for any gamma curve in the group of gamma curves, adjusting the gamma curve according to a target light-emitting current of the sub-pixel having the corresponding color to obtain an adjusted gamma curve; and driving the sub-pixels in the first pixel unit and the second pixel unit to emit light through the group of adjusted gamma curves.

In a third aspect, a display device is provided. The display device includes the display panel according to the first aspect or any optional mode of the first aspect.

DETAILED DESCRIPTION

Figure 1:
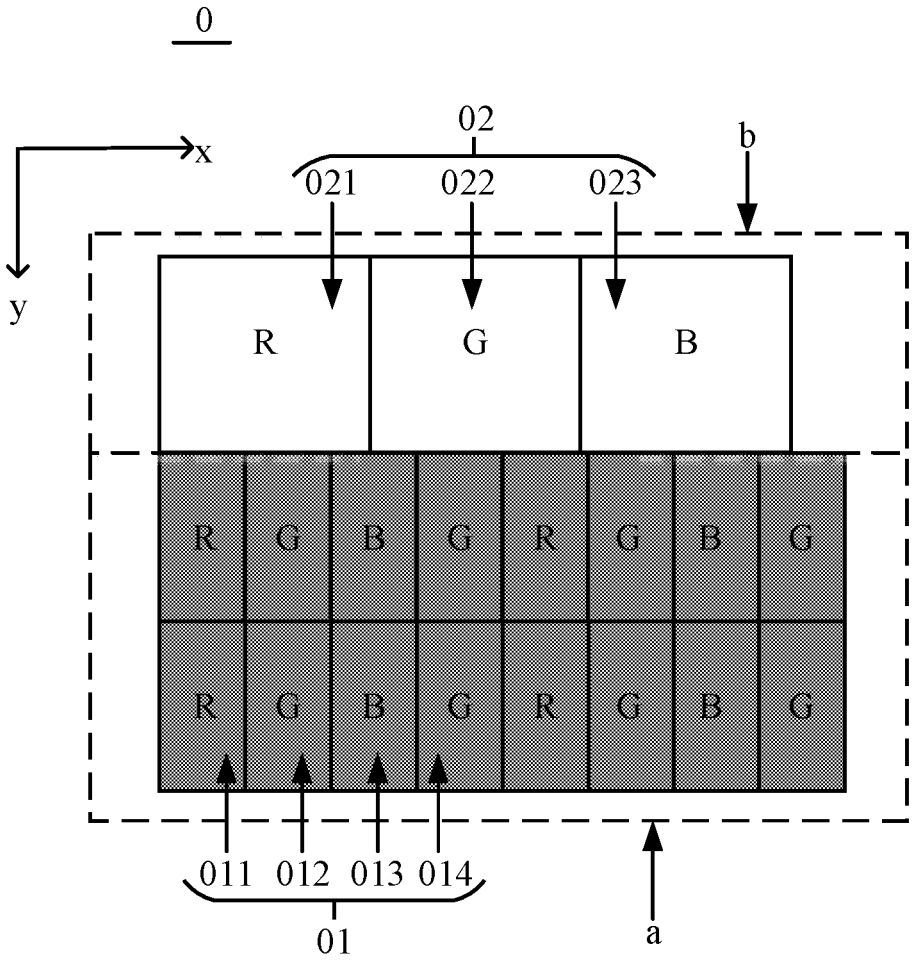
FIG. 1 is a front view of a display panel involved in an embodiment of the present application.

For clearer descriptions of the principles, technical solutions and advantages in the present application, the present application is described in detail hereinafter in combination with the accompanying drawings. Apparently, the described embodiments are merely some embodiments, rather than all embodiments, of the present application. Based on the embodiments of the present application, all other embodiments derived by a person of ordinary skill in the art without creative efforts shall fall within the protection scope of the present application.

As the display technology develops, concepts such as transparent display and virtual reality have gradually entered people's lives. Existing display devices include a thin film transistor liquid crystal display (TFT-LCD) display device and an OLED display device. The TFT-LCD display device may achieve transparent display by removing a backlight module and increasing light sources outside. However, the transparent display effect is poorer and it is difficult to achieve full-color display and high-luminance display. Therefore, the existing transparent display device is usually the OLED display device.

In the OLED display device, structures such as an optical sensor are usually disposed on a side of the OLED display panel facing away from a light-emergence surface thereof. Thus, it needs to set a region, corresponding to the optical sensor, on the OLED display panel to be a transparent region for sensing light by the optical sensor. Currently, it can be achieved by reducing the PPI of the region, corresponding to the optical sensor, on the OLED display panel, to reduce the transparency of the region. However, in the OLED display panel, for improving the resolution of the OLED display panel, sub-pixels are usually arranged in a sub-pixel rendering (SPR) mode. If the sub-pixels in the transparent region are arranged in the SPR mode, the transparent region will have the problems such as poor image quality of a displayed image and color edges due to the relatively lower PPI of the transparent region.

For solving the problems, such as poor image quality of the displayed image and color edges, of the transparent region, currently, the sub-pixels in the transparent region are usually arranged in a conventional mode (i.e., RGB arrangement mode). Exemplarily, with reference to FIG. 1 which shows a front view of an OLED display panel 0 involved in an embodiment of the present application. The OLED display panel 0 has a non-transparent region a and a transparent region b. A PPI of the transparent region b is less than a PPI of the non-transparent region a. A plurality of first pixel units 01 is disposed in the non-transparent region a. The first pixel unit 01 includes a red sub-pixel 011, a green sub-pixel 012, a blue sub-pixel 013 and a green sub-pixel 014. At least one second pixel unit 02 is disposed in the transparent region b. The second pixel unit 02 includes a red sub-pixel 021, a green sub-pixel 022 and a blue sub-pixel 023. The sub-pixels in the non-transparent region a are arranged in an SPR mode. The sub-pixels in the transparent region b are arranged in an RGB mode. Light-emitting surfaces of the red sub-pixel 011, the green sub-pixel 012, the blue sub-pixel 013 and the green sub-pixel 014 are equal in area and light-emitting surfaces of the red sub-pixel 021, the green sub-pixel 022 and the blue sub-pixel 023 are equal in area.

At present, the OLED display panel can be driven by a group of gamma curves for display. The OLED display panel is a current-type display panel. As the operating voltage of a TFT for driving the sub-pixel is in a linear range of a transfer characteristic, the operating voltage has a narrow range. As a result, the OLED display panel is very sensitive to changes in input voltage and differences as small as a few millivolts will also be reflected in the display effect. However, it is difficult to limit differences in product characteristics to a millivolt-level by using the existing production processes of the OLED display panel and driving chips. Consequently, it usually needs to preform gamma correction on the OLED display panel before the OLED display panel leaves the factory. The group of gamma curves includes three gamma curves, which are in one-to-one correspondence with the red sub-pixel, the green sub-pixel and the blue sub-pixel of the OLED display panel, respectively. For example, with reference to FIG. 1, the corresponding gamma curves may be adjusted by adjusting gamma voltages of the sub-pixels having different colors in the non-transparent region a and thus the group of gamma curves is adjusted, thereby achieving gamma correction on the OLED display panel 0. Each adjusted gamma curve is configured to drive the sub-pixel having the corresponding color to emit light and characterizes a relationship between a gamma voltage (i.e., a voltage of a TFT for inputting this sub-pixel) and a light-emitting current (i.e., an output current of the TFT of the sub-pixel) of the sub-pixel having the corresponding color. When a gamma voltage on the corresponding gamma curve is input to the sub-pixel having certain color, the light-emitting current of the sub-pixel is a current, corresponding to the gamma voltage, on the gamma curve. The first pixel unit 01 in the non-transparent region a includes one red sub-pixel, one blue sub-pixel and two green sub-pixels. For ensuring the luminance balance of red light (light emitted from the red sub-pixel), green light (light emitted from the green sub-pixels) and blue light (light emitted from the blue sub-pixel) of the first pixel unit 01, in the group of gamma curves adjusted by adjusting the gamma voltages of the sub-pixels having different colors respectively in the non-transparent region a, under the same gamma voltage, a light-emitting current of the red sub-pixel is equal to that of the blue sub-pixel, and a light-emitting current of the green sub-pixel is half of the light-emitting current of the red sub-pixel. As such, when the first pixel unit 01 is in a white balance state (i.e., the state in which the first pixel unit 01 emits white light), the luminance of emitted light of the red sub-pixel is equal to that of the blue sub-pixel, and is equal to the sum of the luminance of emitted light of the two green sub-pixels. The process of driving the above OLED display panel 0 by the group of gamma curves for display includes: the same gamma voltage is input to the sub-pixels having the same color in the non-transparent region a and the transparent region b through the group of adjusted gamma curves.

However, as the second pixel unit 02 in the transparent region b includes one red sub-pixel, one green sub-pixel and one blue sub-pixel, when the same gamma voltage is input to the red sub-pixel 021, the green sub-pixel 022 and the blue sub-pixel 023 of the second pixel unit 02 through the group of adjusted gamma curves, in the second pixel unit 02, a light-emitting current of the red sub-pixel 021 is equal to that of the blue sub-pixel 023, and a light-emitting current of the green sub-pixel 022 is half of the light-emitting current of the red sub-pixel 021. As a result, the luminance of emitted light of the red sub-pixel 021 is equal to that of the blue sub-pixel 023, and the luminance of emitted light of the green sub-pixel 022 is half of the luminance of emitted light of the red sub-pixel 021 and thus the second pixel unit 02 has color deviation.

For avoiding color deviation of the second pixel unit 02, one group of gamma curves may be disposed for each of the non-transparent region a and the transparent region b, the non-transparent region a and the transparent region b are driven respectively by two groups of gamma curves for display. In this way, however, when gamma correction is performed on the OLED display panel, it needs to adjust two groups of gamma curves respectively, resulting in a complex gamma correction process for the OLED display panel.

In a display panel and a driving method thereof, and a display device according to the present application, there are two sub-pixels in a first pixel unit whose emission colors are a first color; there are two adjacent sub-pixels in a second pixel unit whose emission colors are the first color and the two adjacent sub-pixels are in the same sub-pixel region; and each of the first pixel units and the second pixel unit includes a sub-pixel whose emission color is a second color and a sub-pixel whose emission color is a third color. Therefore, when the same gamma voltage is input to the sub-pixels having the same color in the first pixel unit and the second pixel unit, in the first pixel units and the second pixel unit, the luminance of the second color is equal to the luminance of the third color, and the total luminance of the first color is equal to the luminance of the second color. Thus, the color deviation of the second pixel unit appearing when the first pixel unit and the second pixel unit are driven by the group of gamma curves is alleviated, and the gamma correction process of the display panel can be simplified.

Figure 2:
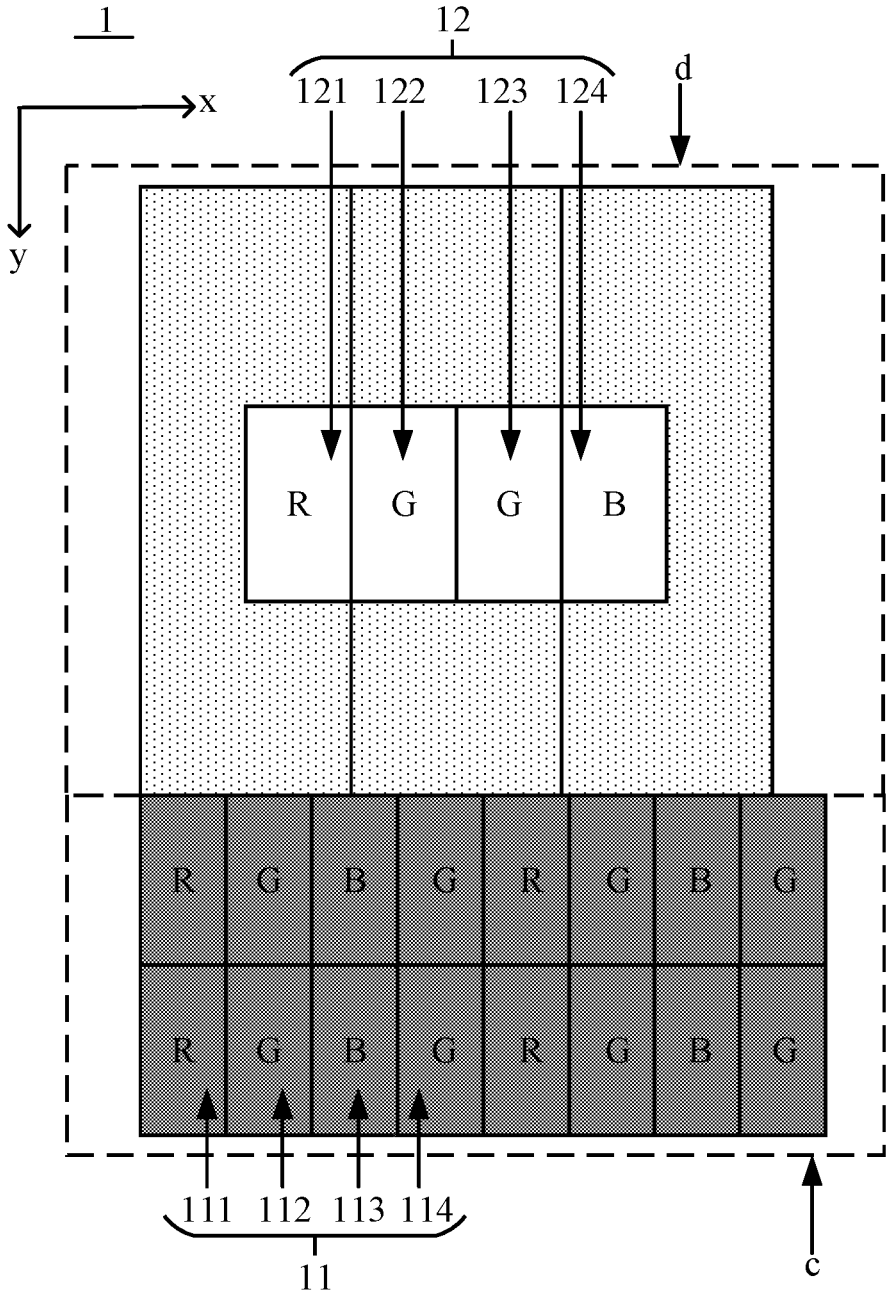
FIG. 2 is a front view of a display panel according to an embodiment of the present application.

With reference to FIG. 2 which shows a front view of a display panel 1 according to an embodiment of the present application. The display panel 1 includes a plurality of first pixel units 11 and at least one second pixel unit 12. Each of the first pixel units 11 and the second pixel unit 12 includes a plurality of sub-pixels, respectively. Each of the sub-pixels in the first pixel unit 11 is in one sub-pixel region, and there are two of the sub-pixels in the first pixel unit 11 whose emission colors are a first color. There are two adjacent sub-pixels in the second pixel unit 12 whose emission colors are the first color, and the two adjacent sub-pixels are in the same sub-pixel region.

When both the first pixel unit 11 and the second pixel unit 12 are in a white balance state, a light-emitting current of the sub-pixel whose emission color is a second color is equal to that of the sub-pixel whose emission color is a third color, and is two times a light-emitting current of the sub-pixel whose emission color is the first color, light-emitting currents of the sub-pixels whose emission colors are the same are equal, and the first color, the second color and the third color are different from one another. The white balance state refers to a state in which the pixel unit emits white light, i.e., a state in which the pixel unit displays white. For example, when being in the white balance state, the first pixel unit 11 emits white light.

In the display panel 1 according to the embodiment of the present application, there are two of the sub-pixels in the first pixel unit 11 whose emission colors are the first color; there are two adjacent sub-pixels in the second pixel unit 12 whose emission colors are the first color and the two adjacent sub-pixels are in the same sub-pixel region; and each of the first pixel units 11 and the second pixel unit 12 includes the sub-pixel whose emission color is the second color and the sub-pixel whose emission color is the third color. Therefore, when the same gamma voltage is input to the sub-pixels having the same color in the first pixel unit 11 and the second pixel unit 12, in both the first pixel unit 11 and the second pixel unit 12, the light-emitting current of the sub-pixel whose emission color is the second color is equal to that of the sub-pixel whose emission color is the third color, and is two times the light-emitting current of the sub-pixel whose emission color is the first color. As such, in both the first pixel unit 11 and the second pixel unit 12, the luminance of the second color is equal to the luminance of the third color, and the total luminance of the first color is equal to the luminance of the second color. Hence, when the same gamma voltage is input to the sub-pixels having the same color in the first pixel unit 11 and the second pixel unit 12, both the first pixel unit 11 and the second pixel unit 12 are in the white balance state and there is no color deviation in the first pixel unit 11 and the second pixel unit 12 and thus the first pixel unit 11 and the second pixel unit 12 can be driven by the same group of gamma curves to emit light.

In summary, for the display panel according to the embodiment of the present application, as the first pixel unit and the second pixel unit can be driven by the same group of gamma curves to be in the white balance state, the color deviation of the second pixel unit appearing when the first pixel unit and the second pixel unit are driven by the same group of gamma curves to emit light can be alleviated. In addition, when gamma correction is performed on the display panel, it only needs to adjust one group of gamma curves, thereby simplifying the gamma correction process of the display panel.

Optionally, as shown in FIG. 2, the display panel 1 has a non-transparent region c in which the first pixel unit 11 is located; and a transparent region d in which the second pixel unit 12 is located.

Optionally, the first pixel unit 11 includes the plurality of sub-pixels arranged in an SPR mode. As shown in FIG. 2, the first pixel unit 11 includes a first sub-pixel 111, a second sub-pixel 112, a third sub-pixel 113, and a fourth sub-pixel 114 which are sequentially arranged along a data line scanning direction x. Emission colors of both the second sub-pixel 112 and the fourth sub-pixel 114 are the first color, an emission color of the first sub-pixel 111 is the second color, and an emission color of the third sub-pixel 113 is the third color. The second pixel unit 12 includes a first sub-pixel 121, a second sub-pixel 122, a third sub-pixel 123, and a fourth sub-pixel 124 which are sequentially arranged along the data line scanning direction x. Emission colors of both the second sub-pixel 122 and the third sub-pixel 123 are the first color, an emission color of the first sub-pixel 121 is the second color, and an emission color of the fourth sub-pixel 124 is the third color. The second sub-pixel 122 and the third sub-pixel 123 are in the same sub-pixel region. Optionally, the first color may be green, the second color may be red, and the third color may be blue. Thus, the first pixel unit 11 includes a red sub-pixel, a green sub-pixel, a blue sub-pixel, and a green sub-pixel which are sequentially arranged along the data line scanning direction x. The second pixel unit 12 includes a red sub-pixel, a green sub-pixel, a green sub-pixel and a blue sub-pixel which are sequentially arranged along the data line scanning direction x. It will be readily understood that in FIG. 2, the description is given by taking the first color as green, the second color as red and the third color as blue. In practical application, the first color, the second color and the third color are interchangeable. For example, the first color is blue, the second color is red and the third color is green or the first color is red, the second color is green and the third color is blue. This is not limited in the embodiment of the present application. However, no matter how the first color, the second color and the third color are changed, there are two sub-pixels in the first pixel unit 11 whose emission colors are the first color; there are two adjacent sub-pixels in the second pixel unit 12 whose emission colors are the first color and in the second pixel unit 12, the two sub-pixels whose emission colors are the same are in the same sub-pixel region.

Optionally, light-emitting surfaces of the plurality of sub-pixels in the first pixel unit 11 are equal in area, and light-emitting surfaces of the plurality of sub-pixels in the second pixel unit 12 are equal in area. The light-emitting surface of each sub-pixel in the first pixel unit 11 may also have an area equal to that of the light-emitting surface of each sub-pixel in the second pixel unit 12. Exemplarily, the light-emitting surface of each sub-pixel in the first pixel unit 11 may have an area of $2t^2$, the light-emitting surface of each sub-pixel in the second pixel unit 12 may have an area of $n^2$, and $2t^2$ may equal to $n^2$. Each sub-pixel in the first pixel unit 11 and each sub-pixel in the second pixel unit 12 are rectangular. Optionally, each sub-pixel in the first pixel unit 11 may have a length of t in the data line scanning direction x and a length of 2t in a gate line scanning direction y, so that the light-emitting surface of each sub-pixel in the first pixel unit 11 has an area of $2t^2$. Each sub-pixel in the second pixel unit 12 may have a length of n in both the data line scanning direction x and the gate line scanning direction y, so that the light-emitting surface of each sub-pixel in the second pixel unit 12 has an area of $n^2$. It will be readily understood by a person skilled in the art that the description is given in the embodiment of the present application by taking the light-emitting surface of the sub-pixel as being rectangular. As the sub-pixel usually includes a TFT and the TFT does not emit light, the area of the light-emitting surface of the sub-pixel is usually an area, except the area of the TFT, in the area of the sub-pixel, that is, the light-emitting surface of the sub-pixel may be not rectangular usually. Since the area of the TFT is smaller relative to that of the light-emitting surface of the sub-pixel, the description may be given by taking the light-emitting surface of the sub-pixel as being rectangular (the area of TFT is omitted).

Optionally, in the embodiment of the present application, the display panel 1 may be an electroluminescent display panel. For example, the display panel 1 may be an OLED display panel or a quantum dot light-emitting diode (QLED) display panel. The OLED display panel may be an active-matrix organic light-emitting diode (AMOLED) display panel or a passive-matrix organic light-emitting diode (PMOLED) display panel. Or the display panel 1 may also be other electroluminescent display panel. This is not repeatedly described in the embodiment of the present application.

It should be noted that the pixel unit (including the first pixel unit and the second pixel unit) involved in the embodiment of the present application refers to the smallest unit capable of emitting white light, but is not the smallest display unit. The smallest display unit is usually a pixel. In the embodiment of the present application, one pixel unit includes at least one of the pixels, and one pixel includes at least one of the sub-pixels described in the embodiment of the present application. Exemplarily, the first pixel unit 11 includes a first pixel composed of a first sub-pixel 111 and a second sub-pixel 112, and a second pixel composed of a third sub-pixel 113 and a fourth sub-pixel 114. The first pixel achieves three-primary-color display by sharing the third sub-pixel 113 of the second pixel and the second pixel achieves three-primary-color display by sharing the first sub-pixel 111 adjacent to the fourth sub-pixel 114. Therefore, in each first pixel unit 11, the area of a light-emitting region of the first sub-pixel 111 and the area of a light-emitting region of the third sub-pixel 113 are equal to the area of the light-emitting surface of the first pixel unit 11, and the area of a light-emitting region of the second sub-pixel 112 and the area of a light-emitting region of the fourth sub-pixel 114 are half of the area of the light-emitting surface of the first pixel unit 11. The area of the light-emitting region of the sub-pixel refers to an area of a region to be irradiated by light emitted by the sub-pixel.

It will be readily understood according to the above description that by adopting the solution according to the embodiment of the present application, the color deviation of the second pixel unit can be improved while the gamma correction process of the display panel is simplified. In conjunction with FIGS. 1 and 2, the process of improving the color deviation by the solution according to the embodiment of the present application is illustrated below with an example that the display panel 1 according to the embodiment of the present application is the OLED display panel, the first color is green, the second color is red and the third color is blue.

During display by the OLED display panel, the light-emitting current of any sub-pixel satisfies the formula: I=J*S1, J=L1/η, where I represents the light-emitting current of the sub-pixel in amperes (A), J represents the current density of the light-emitting current in amperes per square meter ($A/m^2$), S1 represents the area of the light-emitting surface of the sub-pixel (which may be called an opening area in some scenarios) in square meters ($m^2$), L1 represents the luminance of emitted light of the sub-pixel in candela per square meter ($cd/m^2$) when the light-emitting current of the sub-pixel is I, and η represents the light-emitting efficiency of the sub-pixel in candela per ampere (cd/A) and is a constant value ε. S1=S2*target aperture ratio, where S2 represents the area ($m^2$) of the light-emitting region of the sub-pixel (i.e., the area of a light-emitting surface of a pixel in which this sub-pixel is located), the target aperture ratio represents the aperture ratio of the sub-pixel in the pixel and is equal to the ratio of the area of the light-emitting surface of the sub-pixel to the area of the light-emitting surface of the pixel in which this sub-pixel is located. By substituting J=L1/η and S1=S2*target aperture ratio into I=J*S1, it may be obtained I=L1/η*S2*target aperture ratio. Thus, it may be obtained I=L/η*S2, and L=L1*target aperture ratio, where L represents the actual luminance ($cd/m^2$) of the emitted light of the sub-pixel in the pixel.

As shown in FIG. 1, in the display panel 0, the area of a light-emitting region of the red sub-pixel 011 and the area of a light-emitting region of the blue sub-pixel 013 are equal to the area of the light-emitting surface of the first pixel unit 01, and the area of a light-emitting region of the green sub-pixel 012 and the area of a light-emitting region of the green sub-pixel 014 are half of the area of the light-emitting surface of the first pixel unit 01. The area of a light-emitting region of each sub-pixel in the second pixel unit 02 is equal to the area of the light-emitting surface of the second pixel unit 02. It is assumed that the red sub-pixel 011, the green sub-pixel 012, the blue sub-pixel 013 and the green sub-pixel 014 have a length of t in the data line scanning direction x and a length of 2t in the gate line scanning direction y, and the red sub-pixel 021, the green sub-pixel 022 and the blue sub-pixel 023 have a length of n in both the data line scanning direction x and the gate line scanning direction y, it may be determined according to the formula I=L/η*S2 that the light-emitting current $I_{R1}$ of the red sub-pixel 011, the light-emitting current $I_{G1}$ of the green sub-pixel 012, the light-emitting current $I_{B1}$ of the blue sub-pixel 013 and the light-emitting current $I_{G1}$ of the green sub-pixel 014 are respectively as follows:

$$I_{R1}=L_{R1}/\varepsilon*(4t*2t)=L_{R1}/\varepsilon*(8t^2);$$

$$I_{G1}=L_{G1}/\varepsilon*(2t*2t)=L_{G1}/\varepsilon*(4t^2);$$

$$T_{B1}=L_{B1}/\varepsilon*(4t*2t)=L_{B1}/\varepsilon*(8t^2); \text{ and}$$

$$I_{G1}=L_{G1}/\varepsilon*(2t*2t)=L_{G1}/\varepsilon*(4t^2).$$

It may be determined according to the formula I=L/η*S2 that the light-emitting current $I_{R2}$ of the red sub-pixel 021, the light-emitting current $I_{G2}$ of the green sub-pixel 022 and the light-emitting current $I_{B2}$ of the blue sub-pixel 023 are respectively as follows:

$$I_{R2}=L_{R2}/\varepsilon*(3n*n)=L_{R2}/\eta*(3n^2);$$

$$I_{G2}=L_{G2}/\varepsilon*(3n*n)=L_{G2}/\varepsilon*(3n^2); \text{ and}$$

$$I_{B2}=L_{B2}/\varepsilon*(3n*n)=L_{B2}/\varepsilon*(3n^2).$$

Thus, the luminance $L_{R2}$ of the red sub-pixel 021, the luminance $L_{G2}$ of the green sub-pixel 022 and the luminance $L_{B2}$ of the blue sub-pixel 021 are respectively as follows:

$$L_{R2}=I_{R2}*\varepsilon/3n^2;$$

$$L_{G2}=I_{G2}*\varepsilon/3n^2; \text{ and}$$

$$L_{B2}=I_{B2}*\varepsilon/3n^2.$$

After one group of adjusted gamma curves is obtained by adjusting the gamma voltages of the sub-pixels (including the sub-pixels of the first pixel unit 01) having different colors respectively in the non-transparent region a for performing gamma correction on the display panel 0, when the first pixel unit 01 in the non-transparent region a and the second pixel unit 02 in the transparent region b are driven by this group of adjusted gamma curves to emit light, the same gamma voltage is input to the sub-pixels having the same color in the first pixel unit 01 and the second pixel unit 02, and the light-emitting currents of the sub-pixels having the same color are a current, corresponding to the gamma voltage, on the corresponding gamma curve (i.e., a gamma curve corresponding to the color). Therefore, in the second pixel unit 02 and the first pixel unit 01, the light-emitting currents of the sub-pixels having the same color are equal. That is, $I_{R2}=I_{R1}$, $I_{G2}=I_{G1}$, $I_{B2}=I_{B1}$. By substituting $I_{R1}=L_{R1}/\varepsilon*(8t^2)$, $I_{G1}=L_{G1}/\varepsilon*(4t^2)$ and $I_{B1}=L_{B1}/\varepsilon*(8t^2)$ into $L_{R2}=I_{R2}*\varepsilon/3n^2$, $L_{G2}=I_{G2}*\varepsilon/3n^2$ and $L_{B2}=I_{B2}*\varepsilon/3n^2$, it can be obtained that in the second pixel unit 02, the luminance $L_{R2}$ of the red sub-pixel 021, the luminance $L_{G2}$ of the green sub-pixel 022 and the luminance $L_{B2}$ of the blue sub-pixel 023 are respectively as follows:

$$L_{R2}=L_{R1}/\varepsilon*(8t^2)*\varepsilon/3n^2=L_{R1}*(8t^2)/3n^2;$$

$$L_{G2}=L_{G1}/\varepsilon*(4t^2)*\varepsilon/3n^2=L_{G1}*(4t^2)/3n^2; \text{ and}$$

$$L_{B2}=L_{B1}/\varepsilon*(8t^2)*\varepsilon/3n^2=L_{B1}*(8t^2)/3n^2.$$

It can be seen that $L_{R2}=L_{B2}=2L_{G2}$. That is, the luminance of emitted light of the red sub-pixel 021 is equal to that of the blue sub-pixel 023, and the luminance of emitted light of the green sub-pixel 022 is half of the luminance of emitted light of the red sub-pixel 021 and thus the second pixel unit 02 has color deviation.

In the embodiment of the present application, as shown in FIG. 2, in the display panel 1, the area of the light-emitting region of the first sub-pixel 111 (red sub-pixel) and the area of the light-emitting region of the third sub-pixel 113 (blue sub-pixel) are equal to the area of the light-emitting surface of the first pixel unit 11, and the area of the light-emitting region of the second sub-pixel 112 (green sub-pixel) and the area of the light-emitting region of the fourth sub-pixel 114 (green sub-pixel) are half of the area of the light-emitting surface of the first pixel unit 11; and the area of the light-emitting region of the first sub-pixel 121 (red sub-pixel), the area of the light-emitting region of the second sub-pixel 122 (green sub-pixel), the area of the light-emitting region of the third sub-pixel 123 (green sub-pixel) and the area of the light-emitting region of the fourth sub-pixel 124 (blue sub-pixel) are equal to the area of the light-emitting surface of the second pixel unit 12. It is assumed that the first sub-pixel 111, the second sub-pixel 112, the third sub-pixel 113 and the fourth sub-pixel 114 have a length oft in the data line scanning direction x and a length of 2t in the gate line scanning direction y, and the first sub-pixel 121, the second sub-pixel 122, the third sub-pixel 123 and the fourth sub-pixel 124 have a length of n in both the data line scanning direction x and the gate line scanning direction y, it may be determined according to the formula $I=L/\eta*S2$ that the light-emitting current of the first sub-pixel 111, the light-emitting current $I_{G1}'$ of the second sub-pixel 112, the light-emitting current $I_{B1}'$ of the third sub-pixel 113 and the light-emitting current $I_{G1}'$ of the fourth sub-pixel 114 are respectively as follows:

$$I_{R1}'=L_{R1}'/\varepsilon*(4t*2t)=L_{R1}'/\varepsilon*(8t^2);$$

$$I_{G1}'=L_{G1}'/\varepsilon*(2t*2t)=L_{G1}'/\varepsilon*(4t^2);$$

$$I_{B1}'=L_{B1}'/\varepsilon*(4t*2t)=L_{B1}'/\varepsilon*(8t^2); \text{ and}$$

$$=L_{G1}'/\varepsilon*(2t*2t)=L_{G1}'/\varepsilon*(4t^2).$$

It may be determined according to the formula $I=L/\eta*S2$ that the light-emitting current $I_{R2}'$ of the first sub-pixel 121, the light-emitting current $I_{G2}'$ of the second sub-pixel 122, the light-emitting current $I_{G2}'$ of the third sub-pixel 123 and the light-emitting current $I_{B2}'$ of the fourth sub-pixel 124 are respectively as follows:

$$I_{R2}'=L_{R2}'/\varepsilon*(4n*n)=L_{R2}'/\varepsilon*(4n^2);$$

$$I_{G2}'=L_{G2}'/\varepsilon*(4n*n)=L_{G2}'/\varepsilon*(4n^2);$$

$$I_{G2}'=L_{G2}'/\varepsilon*(4n*n)=L_{G2}'/\varepsilon*(4n^2); \text{ and}$$

$$I_{B2}'=L_{B2}'/\varepsilon*(4n*n)=L_{B2}'/\varepsilon*(4n^2).$$

Thus, the luminance $L_{R2}'$ of the first sub-pixel 121, the luminance $L_{G2}'$ of the second sub-pixel 122, the luminance $L_{G2}'$ of the third sub-pixel 123 and the luminance $L_{B2}'$ of the fourth sub-pixel 124 are respectively as follows:

$$L_{R2}'=I_{R2}'*\varepsilon/4n^2;$$

$$L_{G2}'=I_{G2}'*\varepsilon/4n^2;$$

$$L_{G2}'=I_{G2}'*\varepsilon/1n^2; \text{ and}$$

$$L_{B2}'=I_{B2}'*\varepsilon/4n^2.$$

After one group of adjusted gamma curves is obtained by adjusting the gamma voltages of the sub-pixels (including the sub-pixels of the first pixel unit 11) having different colors respectively in the non-transparent region c for performing gamma correction on the display panel 1, when the same gamma voltage is input to the sub-pixels having the same color in the first pixel unit 11 and the second pixel unit 12, and the light-emitting currents of the sub-pixels having the same color are a current, corresponding to the gamma voltage, on the corresponding gamma curve (i.e., a gamma curve corresponding to the same color). Therefore, in the second pixel unit 12 and the first pixel unit 11, the light-emitting currents of the sub-pixels having the same color are equal. That is, $I_{R2}'=I_{R1}'$, $I_{G2}'=I_{G1}'$, and $I_{B2}'=I_{B1}'$. By substituting $I_{R1}'=L_{R1}'/\varepsilon*(8t^2)$, $I_{G1}'=L_{G1}'/\varepsilon*(4t^2)$ and $I_{B1}'=L_{B1}'/\varepsilon*(8t^2)$ into $L_{R2}'=I_{R2}'*\varepsilon/4n^2$, $L_{G2}'=I_{G2}'*\varepsilon/4n^2$ and $L_{B2}'=I_{B2}'*\varepsilon/4n^2$ respectively, it can be obtained that in the second pixel unit 12, the luminance $L_{R2}'$ of the first sub-pixel 121, the luminance $L_{G2}'$ of the second sub-pixel 122, the luminance $L_{G2}'$ of the third sub-pixel 123 and the luminance $L_{B2}'$ of the fourth sub-pixel 124 are respectively as follows:

$$L_{R2}'=L_{R1}'*(8t^2)/4n^2;$$

$$L_{G2}'=L_{G1}'*(4t^2)/4n^2;$$

$$L_{G2}'=L_{G1}'*(4t^2)/4n^2; \text{ and}$$

$$L_{B2}'=L_{B1}*(8t^2)/4n^2.$$

It can be seen that $L_{R2}'=L_{B2}'=L_{G2}'+L_{G2}'$. That is, the luminance of emitted light of the first sub-pixel (red sub-pixel) 121 is equal to that of the fourth sub-pixel (blue sub-pixel) 124, and is equal to a sum of the luminance of emitted light of the second sub-pixel (green sub-pixel) 122 and the luminance of emitted light of the third sub-pixel (green sub-pixel) 123. In other words, the luminance of emitted light of the red sub-pixel is equal to that of the blue sub-pixel, and is equal to the total luminance of the green sub-pixels. Thus, the second pixel unit 12 does not have color deviation.

As one group of adjusted gamma curves is obtained by adjusting the gamma voltages of the sub-pixels (including the sub-pixels of the first pixel unit 11) having different colors respectively in the non-transparent region c for performing gamma correction on the display panel 1, the first pixel unit 11 does not have color deviation when the first pixel unit 11 is driven by this group of adjusted gamma curves to emit light. In addition, it can be seen from the above description that when the second pixel unit 12 is driven by this group of adjusted gamma curves to emit light, the second pixel unit 12 does not have color deviation. Therefore, when the same gamma voltage is input to the sub-pixels having the same color in the first pixel unit 11 and the second pixel unit 12, both the first pixel unit 11 and the second pixel unit 12 are in the white balance state. Hence, the embodiment of the present application can alleviate the color deviation of the second pixel unit appearing when the first pixel unit and the second pixel unit are driven by the group of gamma curves to emit light.

In summary, for the display panel according to the embodiment of the present application, as the first pixel unit and the second pixel unit can be driven by the same group of gamma curves to be in the white balance state, the color deviation of the second pixel unit appearing when the first pixel unit and the second pixel unit are driven by the same group of gamma curves to emit light can be alleviated. In addition, when gamma correction is performed on the display panel, it only needs to adjust one group of gamma curves, thereby simplifying the gamma correction process of the display panel.

Figure 3:
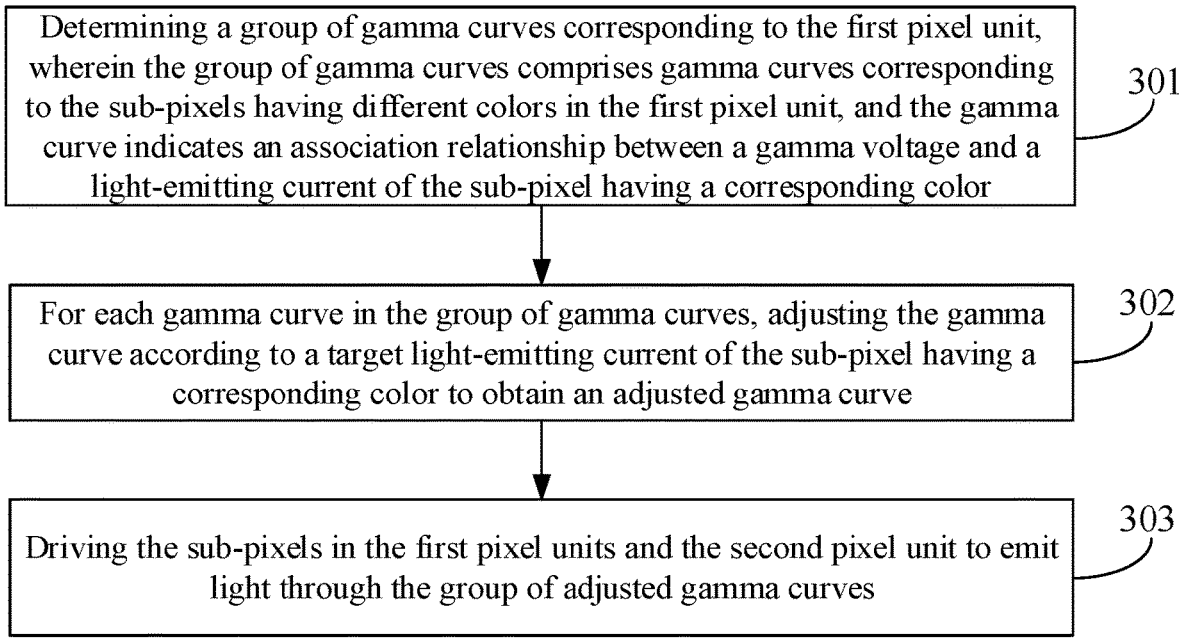
FIG. 3 is a method flow chart of a display panel driving method according to an embodiment of the present application.

With reference to FIG. 3 which shows a method flow chart of a display panel driving method according to an embodiment of the present application. The method may be applied to the display panel 1 according to the above embodiment and may be executed by a display panel driving device which may be a driving circuit, a driving chip or an integrated circuit (IC). With reference to FIG. 3, the method may include the steps as follows.

In step 301, a group of gamma curves corresponding to the first pixel unit is determined, wherein the group of gamma curves includes gamma curves corresponding to the sub-pixels having different colors in the first pixel unit, and the gamma curve indicates an association relationship between a gamma voltage and a light-emitting current of the sub-pixel having a corresponding color.

Optionally, the display panel driving device may store at least one group of gamma curves. The at least one group of gamma curves includes a group of gamma curves corresponding to the first pixel unit. The group of gamma curves corresponding to the first pixel unit includes gamma curves corresponding to the sub-pixels having different colors in the first pixel unit. Exemplarily, the first pixel unit includes a red sub-pixel, a green sub-pixel and a blue sub-pixel. Therefore, the group of gamma curves corresponding to the first pixel unit includes a gamma curve corresponding to the red sub-pixel (such as a gamma curve 1), a gamma curve corresponding to the green sub-pixel (such as a gamma curve 2) and a gamma curve corresponding to the blue sub-pixel (such as a gamma curve 3). The display panel driving device may determine one group of gamma curves corresponding to the first pixel unit from gamma curves stored therein.

In step 302, for each gamma curve, the gamma curve is adjusted according to a target light-emitting current of the sub-pixel having the corresponding color to obtain an adjusted gamma curve.

Optionally, a target light-emitting current may be determined previously by the driving device of the display panel. For each gamma curve, a gamma voltage of a sub-pixel having the corresponding color may be adjusted by the driving device of the display panel, so that a light-emitting current of this sub-pixel is equal to the target light-emitting current. Next, the gamma voltage of the sub-pixel is determined as a target gamma voltage when the light-emitting current of this sub-pixel is equal to the target light-emitting current, and the gamma curve is adjusted according to the target gamma voltage and the target light-emitting current to obtain an adjusted gamma curve.

It will be readily understood by a person skilled in the art that step 302 is described by taking adjustment on one gamma curve as an example. In practical application, the group of gamma curves corresponding to the first pixel unit may include a plurality of gamma curves, the adjustment process of each gamma curve may refer to step 302, and the group of gamma curves may be adjusted by executing step 302 multiple times. This is not repeatedly described in the embodiment of the present application.

In step 303, the sub-pixels in the first pixel unit and the second pixel unit are driven to emit light through the group of adjusted gamma curves.

Optionally, according to each gamma curve in the group of adjusted gamma curves, a gamma voltage is input to the sub-pixel having the corresponding color (i.e., the color corresponding to the gamma curve) in the first pixel unit and the second pixel unit by the driving device of the display panel to drive the sub-pixel having the corresponding color to emit light. That is, the sub-pixels in the first pixel unit and the second pixel unit are driven to emit light.

In summary, for the display panel driving method according to the embodiment of the present application, as the first pixel unit and the second pixel unit can be driven by the group of gamma curves to be in the white balance state, the color deviation of the second pixel unit appearing when the first pixel unit and the second pixel unit are driven by the group of gamma curves to emit light can be alleviated. In addition, when gamma correction is performed on the display panel, it only needs to adjust one group of gamma curves, thereby simplifying the gamma correction process of the display panel.

Based on the same inventive concept, an embodiment of the present application further provides a display device. The display device includes the display panel according to the above embodiment. The display device may be an electroluminescent display device and may be a flexible display device. For example, the display device may be any product or component having a display function, such as electronic paper, a mobile phone, a tablet computer, a television, a display, a laptop computer, a digital photo frame, a navigator, a wearable apparatus or a virtual display apparatus.

The terms "first", "second", "third" and "fourth" in the present application are merely for the purpose of description and should not be construed as indicating or implying relative importance. The term "at least one" means one or more, and the term "a plurality of" means two or more, unless otherwise expressly provided.

Other embodiments of the present application will be readily conceivable by those skilled in the art upon consideration of the description and practice of the present application. The present application is intended to cover any variations, uses, or adaptations of the present application following general principles of the present application and including the common general knowledge or conventional technical means in the art which is not disclosed in the present application. The description and embodiments are to be considered as exemplary only, and a true scope and spirit of the present application are indicated by the following claims.

It will be appreciated that the present application is not limited to the exact construction that has been described above and illustrated in the accompanying drawings, and that various modifications and changes can be made without departing from the scope thereof. It is intended that the scope of the present application is only be limited by the appended claims.

Persons of ordinary skill in the art can understand that all or part of the steps in the above embodiment can be completed through hardware, or through relevant hardware instructed by a program stored in a computer-readable storage medium, such as a read-only memory, a disk or an optical disc.

The above description is only exemplary embodiments of the present application, and is not intended to limit the present application. Any modifications, equivalent replacements, improvements and the like made within the spirit and principles of the present application should be included within the scope of protection of the present application.

What is claimed is:

1. A display panel, comprising: a plurality of first pixel units and at least one second pixel unit, wherein each of the first pixel units and the second pixel unit comprises a plurality of sub-pixels, respectively;

each of the sub-pixels in the first pixel unit is in a sub-pixel region, and emission color of two of the sub-pixels in the first pixel unit is a first color;

the plurality of sub-pixels in the second pixel unit is in a plurality of sub-pixel regions arranged in an array, emission color of two adjacent sub-pixels in the second pixel unit is the first color, and the two adjacent sub-pixels are in the same sub-pixel region; and when the first pixel units and the second pixel unit are in a white balance state, a light-emitting current of the sub-pixel whose emission color is a second color is equal to a light-emitting current of the sub-pixel whose emission color is a third color, and is two times a light-emitting current of the sub-pixel whose emission color is the first color, light-emitting currents of the sub-pixels whose emission colors are the same are equal, and the first color, the second color and the third color are different from one another, wherein the first pixel unit comprises a plurality of the sub-pixels arranged in a sub-pixel rendering (SPR) mode.

2. The display panel according to claim 1, wherein light-emitting surfaces of the plurality of sub-pixels in the first pixel unit are equal in area, and light-emitting surfaces of the plurality of sub-pixels in the second pixel unit are equal in area.

3. The display panel according to claim 1, wherein the display panel has a transparent region and a non-transparent region, the second pixel unit is in the transparent region, and the first pixel unit is in the non-transparent region.

4. The display panel according to claim 1, wherein the first pixel unit comprises a first sub-pixel, a second sub-pixel, a third sub-pixel, and a fourth sub-pixel which are sequentially arranged along a data line scanning direction, emission colors of both the second sub-pixel and the fourth sub-pixel are the first color, an emission color of the first sub-pixel is the second color, and an emission color of the third sub-pixel is the third color.

5. The display panel according to claim 4, wherein the second pixel unit comprises a first sub-pixel, a second sub-pixel, a third sub-pixel, and a fourth sub-pixel which are sequentially arranged along the data line scanning direction, an emission color of the first sub-pixel is the second color, emission colors of both the second sub-pixel and the third sub-pixel are the first color, and an emission color of the fourth sub-pixel is the third color.

6. The display panel according to claim 5, wherein the first color is green, the second color is red, and the third color is blue.

7. The display panel according to claim 1, wherein the display panel is an electroluminescent display panel.

8. A display panel driving method, wherein the display panel comprises a plurality of first pixel units and at least one second pixel unit, wherein each of the first pixel units and the second pixel unit comprises a plurality of sub-pixels, respectively, each of the sub-pixels in the first pixel unit is in a sub-pixel region, and emission color of two of the sub-pixels in the first pixel unit is a first color, the plurality of sub-pixels in the second pixel unit is in a plurality of sub-pixel regions arranged in an array, emission color of two adjacent sub-pixels in the second pixel unit is the first color, and the two adjacent sub-pixels are in the same sub-pixel region, and the method comprises:

determining a group of gamma curves corresponding to the first pixel unit, wherein the group of gamma curves comprises gamma curves corresponding to the sub-pixels having different colors in the first pixel unit, and the gamma curve indicates an association relationship between a gamma voltage and a light-emitting current of the sub-pixel having a corresponding color;

for each gamma curve in the group of gamma curves, adjusting the gamma curve according to a target light-emitting current of the sub-pixel having a corresponding color to obtain an adjusted gamma curve; and driving the sub-pixels in the first pixel units and the second pixel unit to emit light through the group of adjusted gamma curves, wherein the first pixel unit comprises a plurality of the sub-pixels arranged in a sub-pixel rendering (SPR) mode.

9. A display device, comprising a display panel, wherein the display panel comprises a plurality of first pixel units and at least one second pixel unit, wherein each of the first pixel units and the second pixel unit comprises a plurality of sub-pixels, respectively;

each of the sub-pixels in the first pixel unit is in a sub-pixel region, and emission color of two of the sub-pixels in the first pixel unit is a first color;

the plurality of sub-pixels in the second pixel unit is in a plurality of sub-pixel regions arranged in an array, emission color of two adjacent sub-pixels in the second pixel unit is the first color, and the two adjacent sub-pixels are in the same sub-pixel region; and when the first pixel units and the second pixel unit are in a white balance state, a light-emitting current of the sub-pixel whose emission color is a second color is equal to a light-emitting current of the sub-pixel whose emission color is a third color, and is two times a light-emitting current of the sub-pixel whose emission color is the first color, light-emitting currents of the sub-pixels whose emission colors are the same are equal, and the first color, the second color and the third color are different from one another, wherein the first pixel unit comprises a plurality of the sub-pixels arranged in a sub-pixel rendering (SPR) mode.

10. The display panel according to claim 7, wherein the-display panel is one of an OLED display panel and a QLED display panel.

11. The display panel according to claim 1, wherein the display panel has a transparent region and a non-transparent region, the second pixel unit is in the transparent region, and the first pixel unit is in the non-transparent region;

light-emitting surfaces of the plurality of sub-pixels in the first pixel unit are equal in area, the first pixel unit comprises a first sub-pixel, a second sub-pixel, a third sub-pixel, and a fourth sub-pixel which are sequentially arranged along a data line scanning direction, emission colors of both the second sub-pixel and the fourth sub-pixel are the first color, an emission color of the first sub-pixel is the second color, and an emission color of the third sub-pixel is the third color; and, light-emitting surfaces of the plurality of sub-pixels in the second pixel unit are equal in area, the second pixel unit comprises a first sub-pixel, a second sub-pixel, a third sub-pixel, and a fourth sub-pixel which are sequentially arranged along the data line scanning direction, an emission color of the first sub-pixel is the second color, emission colors of both the second sub-pixel and the third sub-pixel are the first color, and an emission color of the fourth sub-pixel is the third color;

wherein, the first color is green, the second color is red, and the third color is blue.

12. The method according to claim 8, wherein said for each gamma curve in the group of gamma curves, adjusting the gamma curve according to a target light-emitting current of the sub-pixel having a corresponding color to obtain an adjusted gamma curve, comprises:

for each gamma curve in the group of gamma curves, adjusting a light-emitting current of the sub-pixel having a corresponding color, to make the light-emitting current of the sub-pixel equal to the target light-emitting current;

determining a gamma voltage of the sub-pixel as a target gamma voltage when the light-emitting current of the sub-pixel is equal to the target light-emitting current; and adjusting the gamma curve according to the target gamma voltage and the target light-emitting current, to obtain an adjusted gamma curve.

13. The display device according to claim 9, wherein light-emitting surfaces of the plurality of sub-pixels in the first pixel unit are equal in area, and light-emitting surfaces of the plurality of sub-pixels in the second pixel unit are equal in area.

14. The display device according to claim 9, wherein the display panel has a transparent region and a non-transparent region, the second pixel unit is located in the transparent region, and the first pixel unit is located in the non-transparent region.

15. The display device according to claim 9, wherein the first pixel unit comprises a first sub-pixel, a second sub-pixel, a third sub-pixel, and a fourth sub-pixel which are sequentially arranged along a data line scanning direction, emission colors of both the second sub-pixel and the fourth sub-pixel are the first color, an emission color of the first sub-pixel is the second color, and an emission color of the third sub-pixel is the third color.

16. The display device according to claim 15, wherein the second pixel unit comprises a first sub-pixel, a second sub-pixel, a third sub-pixel, and a fourth sub-pixel which are sequentially arranged along the data line scanning direction, an emission color of the first sub-pixel is the second color, emission colors of both the second sub-pixel and the third sub-pixel are the first color, and an emission color of the fourth sub-pixel is the third color.

17. The display device according to claim 16, wherein the first color is green, the second color is red, and the third color is blue.

18. The display device according to claim 9, wherein the display panel is an electroluminescent display panel.

* * * * *